US005666615A

United States Patent [19]

Nguyen

[11] Patent Number: 5,666,615

[45] Date of Patent: Sep. 9, 1997

[54] MINIMAL LIQUID CARRIER TRANSFER IN AN IMAGE FORMATION PROCESS

[75] Inventor: Khe C. Nguyen, Los Altos, Calif.

[73] Assignee: Hewlett-Packard Company, Palo Alto, Calif.

[21] Appl. No.: 383,288

[22] Filed: Feb. 3, 1995

[51] Int. Cl.[6] ..... G03G 13/10; G03G 15/10

[52] U.S. Cl. ..... 399/240; 399/249

[58] Field of Search ..... 355/256; 399/237, 399/239, 240, 249

[56] References Cited

U.S. PATENT DOCUMENTS

| | | | |
|---|---|---|---|
| 3,368,894 | 2/1968 | Matkan et al. | 355/256 X |
| 3,814,517 | 6/1974 | Brock | 355/256 X |
| 3,875,581 | 4/1975 | Yamashita et al. | 355/256 X |
| 3,991,711 | 11/1976 | Nakano et al. | 355/256 X |
| 4,024,838 | 5/1977 | Horie | 355/256 X |
| 4,043,657 | 8/1977 | Karnik | 355/256 |
| 4,068,938 | 1/1978 | Robertson | 355/4 |
| 4,202,620 | 5/1980 | Klavan et al. | 355/256 |
| 4,245,023 | 1/1981 | Cassiers et al. | 355/256 X |
| 5,300,990 | 4/1994 | Thompson | 355/256 |
| 5,352,558 | 10/1994 | Simms et al. | 355/256 X |
| 5,477,313 | 12/1995 | Kuramochi et al. | 355/256 |

FOREIGN PATENT DOCUMENTS

| | | |
|---|---|---|
| 3006781 | 8/1980 | Germany . |
| 53-094942 | 8/1978 | Japan . |

*Primary Examiner*—Fred L. Braun

[57] ABSTRACT

An electrographic development process with liquid toner. In the process charged toner particles are moved electrostatically from the liquid dispersion containing them to a charged photoconductor surface. An intermediate development component collects the charged toner particles from the dispersion and carries them out of the liquid phase in a manner to reduce the amount of liquid carrier that is applied to the image bearing substrate or photoconductor. In one embodiment of the invention an intermediate conductive substrate and at least one squeeze mechanism are placed between the dispersion and the photoconductor surface. An electrical bias with the same polarity as the toner particles is applied between the conductive substrate and the first squeeze mechanism. In another embodiment of the invention, the toner dispersion is a high-concentrate slurry, and no roller is necessary between the dispersion and the photoconductor surface.

19 Claims, 5 Drawing Sheets

MINIMAL LIQUID CARRIER TRANSFER IN AN IMAGE FORMATION PROCESS

BACKGROUND OF THE INVENTION

1. Technical Field

This invention generally relates to image transfer technology, and more specifically to electrophotography. The invention is a laser printer developer for liquid toners which minimizes the carry-out of toner liquid.

2. Background Art

In electrophotography, a latent image is created on the surface of an insulating, photo-conducting material by selectively exposing areas of the surface to light. A difference in electrostatic charge density is created between the areas on the surface exposed and unexposed to light. The visible image is developed by electrostatic toners containing pigment components dispersed in an insulating binder. Two types of developer materials are typically employed in the electrostatographic imaging process. The first type of developer material is known as a dry developer material and comprises toner particles, or carrier granules having toner particles adhering tribo-electrically to the carrier granule. The second type of developer material is in the form of a liquid developer, comprising a liquid carrier having toner particles dispersed within the liquid carrier. The toners are selectively attracted to the photoconductor surface areas either exposed or unexposed to light, depending on the relative electrostatic charges of the photoconductor surface, development electrode and the toner. The photoconductor may be either positively or negatively charged, and the toner system similarly may contain negatively or positively charged particles. For laser printers, the preferred embodiment is that the photoconductor and toner have the same type, but different levels of charge.

Another type of electro statographic printing is known as ion injection or ion deposition printing. In this printing process, the electrostatic latent image is formed on an insulator which receives the ion from the print head.

A sheet of paper or intermediate transfer medium is given an electrostatic charge opposite that of the toner and passed close to the photoconductor surface, pulling the toner from the photoconductor surface onto the paper or intermediate medium still in the pattern of the image developed from the photoconductor surface. Thermal energy may also be used to assist transfer of the image to paper or intermediate transfer medium. For the case where no thermal transfer is used, a set of fuser rollers melts and fixes the toner in the paper subsequent to direct transfer or indirect transfer when using an intermediate transfer medium, producing the printed image.

There is a demand in the laser printer industry for multi-colored images. Responding to this demand, designers have turned to liquid toners, with pigment components and thermoplastic components dispersed in a liquid carrier medium, as described previously. Usually the liquid carrier is composed of aliphatic hydrocarbon liquids. With liquid toners, it has been discovered, the basic printing colors—yellow, magenta, cyan and black, may be applied sequentially to a photoconductor surface, and from there to a sheet of paper or intermediate medium to produce a multi-colored image.

With liquid toners, however, there is a need to remove the liquid carrier medium from the photoconductor surface after the toner has been applied to it. With the liquid carrier medium removed, the photoconductor surface will not transfer the liquid carrier to the paper or to the intermediate medium in the image transfer step(s). Additionally, the removal allows the liquid carrier to be recovered for recycling and reuse in the developer system. Recycling and reuse represent an advantage by providing economy in terms of printing supplies, and eliminating environmental and health concerns from disposal of excess liquid carrier medium.

It is known from U.S. Pat. No. 3,955,533 to employ a reverse direction roller spaced about 50 microns (about 0.002 inches) from the photoconductor surface to shear off the carrier liquid and excess pigmented solids in the region beyond the outer edge of the image to leave relatively clean background areas on the photoconductor surface.

Also, U.S. Pat. No. 3,957,016, discloses a negative toner system using a positive biased reverse roller maintained at a voltage intermediate to the image and background voltages to help clean the background and compact the image on the photoconductor surface.

Additionally, U.S. Pat. No. 4,286,039, teaches a positive toner system using a reverse roller followed by a negatively biased squeegee roller. The squeegee roller serves two functions, it both compacts the latent image and removes excess carrier liquid.

U.S. Pat. Nos. 4,974,027 and 4,999,677 disclose a positively biased reverse roller followed by a negatively biased rigidizing roller followed by a squeegee roller, separate from the rigidizing roller, for removing excess carrier liquid from the image after rigidization. The charge on these rollers may be reversed if the charge on the toner is reversed. In these two patents, an intermediate transfer drum is downstream of the rigidizing roller for receiving the toner image from the photoconductor surface and transferring the image to a sheet of paper.

U.S. Pat. Nos. 4,299,902, Soma et al., 4,985,733 Kurotori et al., 4,392,742 Landa, and 5,352,558 Smith et al. all disclose similar procedures of removal of excess liquid on the photoconductor surface using a squeezable absorption material. Excess liquid can be removed from the photoconductor surface by incorporating microporosity and compliant properties into the materials on a surface of a flexible belt or roller. By using materials with these properties it is possible to achieve higher solid content of toner of an undeveloped image with liquid developer. This solid content may reach the level of 50%–70%, which exhibits some degree of the dryness in the developed image, compared to the image just developed right at the developer station which is roughly 15% using the process of U.S. Pat. No. 5,352,558, where the solid content of the toner in the reservoir is about 2%–3%. While these other processes allow some improvement in decreasing excess liquid carrier, they also possess the disadvantage of increasing the complexity of the imaging process by using liquid absorbing materials which require extra efforts for cleaning and storage of the excess liquid that is collected.

There is still a need in the electrophotography industry for a liquid toner developer which provides a simple and efficient process for producing a rigid image leaving the developer unit which is drier than the available processes (with a solid content greater than 80 wt. %) and suitable for direct contact with the paper or intermediate transfer medium onto which the image will be transferred with minimal release of the liquid carrier vapor into the environment.

DISCLOSURE OF THE INVENTION

The invention is an electrographic or electrostatographic dry development process with liquid developer. In this process, an intermediate development conductive substrate component collects the charged toner particles from the liquid carrier, extracting them from the liquid phase. The charged toner particles are then moved electrostatically from the intermediate component roller to an electrostatic latent image bearing substrate, which is a charged photoconductor surface in the preferred embodiment. The excess liquid on the intermediate roller is squeezed back into the dispersion and only a minimal amount of liquid required to complete the development is left behind.

In one embodiment of the invention an intermediate conductive substrate development roller is placed between the dispersion and the photoconductor surface. In another embodiment of the invention, the toner dispersion is a high-concentrate slurry, so there is no roller between the dispersion and the photoconductor surface because the need for extra effort to squeeze the liquid carrier out of the toner image is eliminated.

DETAILED DESCRIPTION OF THE INVENTION

Figure 1:
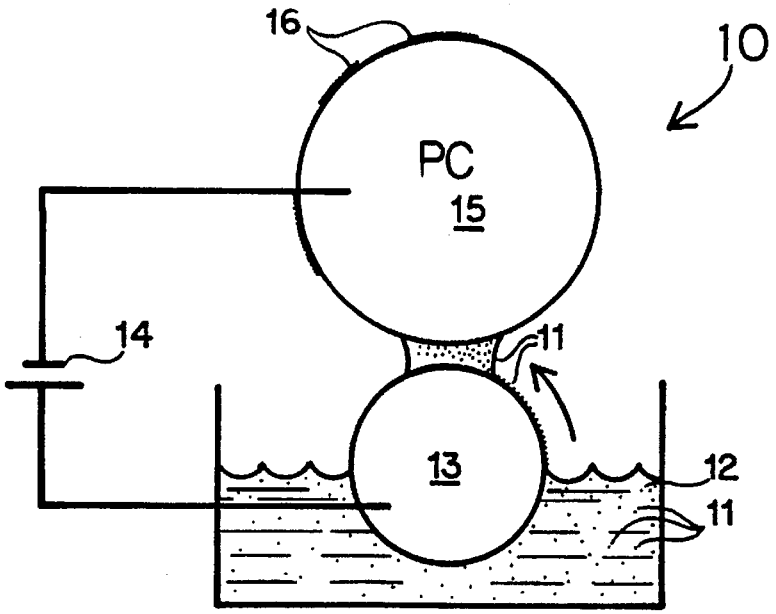
FIG. 1 PRIOR ART
FIG. 1 (prior art) is a schematic version of the conventional method for electrostatographic development with a liquid toner.

Referring to FIGS. 1–5, there is depicted a schematic version 10 of the conventional, wet development electrostatographic process with liquid toner.

In the conventional process 10, photoconductor 15 carries the latent image of an electrostatic charge pattern created by exposing photoconductor 15 successively to a corona charger and to a light source.

This latent image is then developed into a visible image composed of charged colorant particles 11 from liquid carrier or developer bath 12 when the latent image passes development roller 13 biased by voltage source 14. The liquid developer of bath 12 is composed of toner particles 11 and a carrier liquid. This voltage provided by source 14 is known to cause a migration of charged colorant particles 11 in the wet or liquid environment along the direction of the electrical field, crossing the gap between an electrostatic image bearing substrate, here charged photoconductor 15 and a conductive substrate, here development roller 13. The migration of charged colorant particles 11 dispersed in a liquid carrier, such as toner or developer bath 12, in response to electric field is referred to as electrophoresis.

Figure 5C:
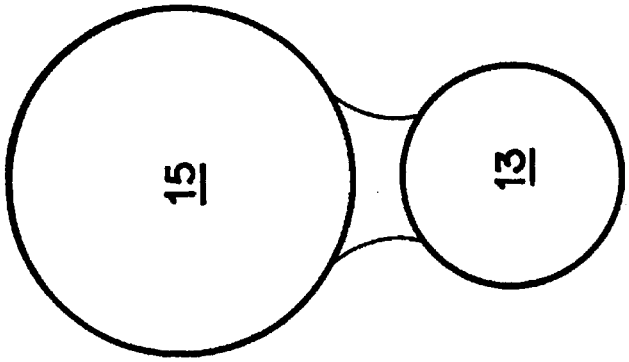
FIGS. 5A, 5B and 5C are schematic versions of one embodiment of this invention, showing the interface between the liquid carrier and the surface of the photoconductor.
Figure 5B:
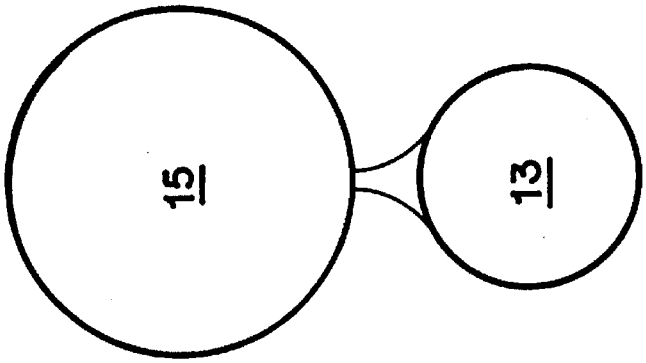

By definition the electrophoresis phenomenum must occur in a liquid, here via a meniscus, as can be seen in FIGS. 5B and 5C. The formation of a large meniscus is illustrated in FIG. 5C, which occurs in this process when there is an excess amount of liquid carrier 12 existing between surfaces of roller 13 and photoconductor 15. The formation of a minimal meniscus, as illustrated in FIG. 5B, is due to the surface tension of liquid against photoconductor, conductive roller surface and occurs in the process of this invention under conditions where there is a reduced amount of liquid carrier 12 between the surfaces of roller 13 and photoconductor 15.

The formation of the large or small meniscus depends upon the amount of liquid carrier 12 and the surface tension of liquid carrier 12, as well as the surface energy of each of components roller 13 and photoconductor 15. When the amount of liquid carrier 12 between roller 13 and photoconductor 15 is minimized, and when the gap is larger than zero, a meniscus is no longer formed, as indicated in FIG. 5A.

Figure 5A:
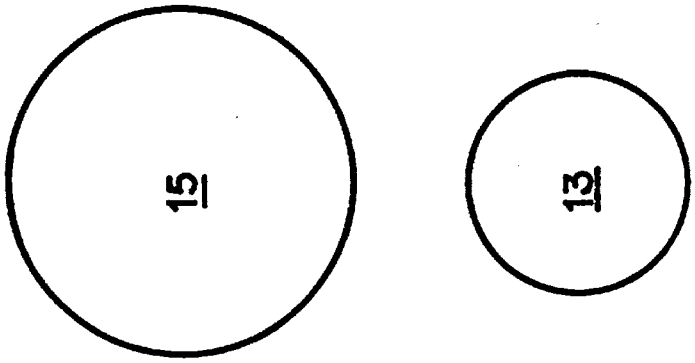

The present invention is related to the development process of liquid toner, without the formation of a meniscus, as illustrated in FIG. 5A, or with formation of a minimal meniscus, as illustrated in FIG. 5B.

Figure 2A:
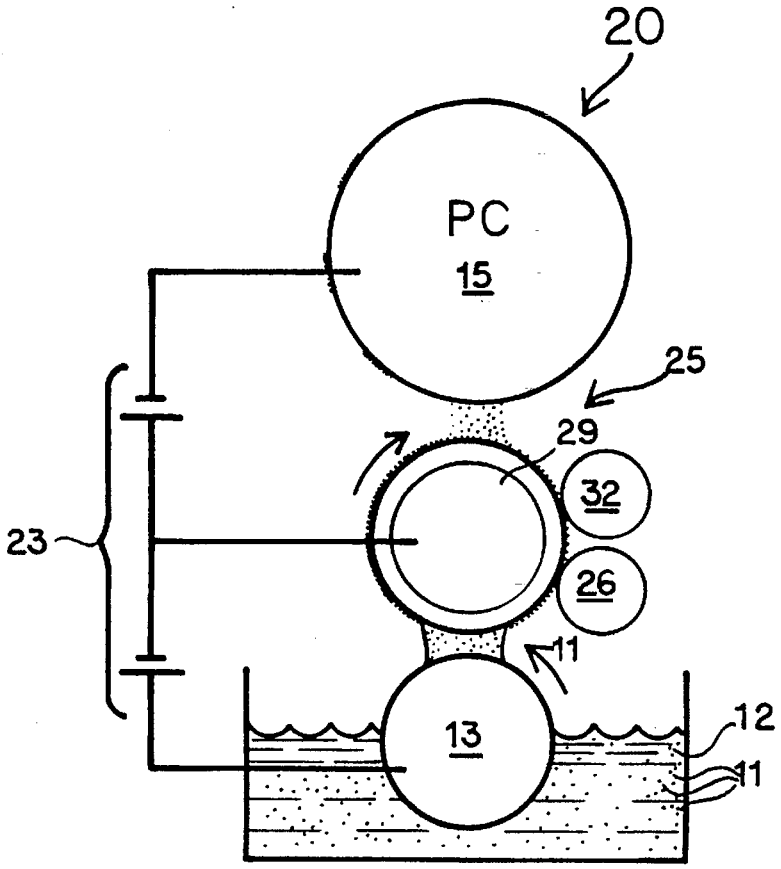
FIG. 2A is a schematic version of one embodiment of the invention with no liquid meniscus formed between the conductive roller and the photoconductor, when the gap between the photoconductor and the conductive roller is greater than zero.
Figure 2B:
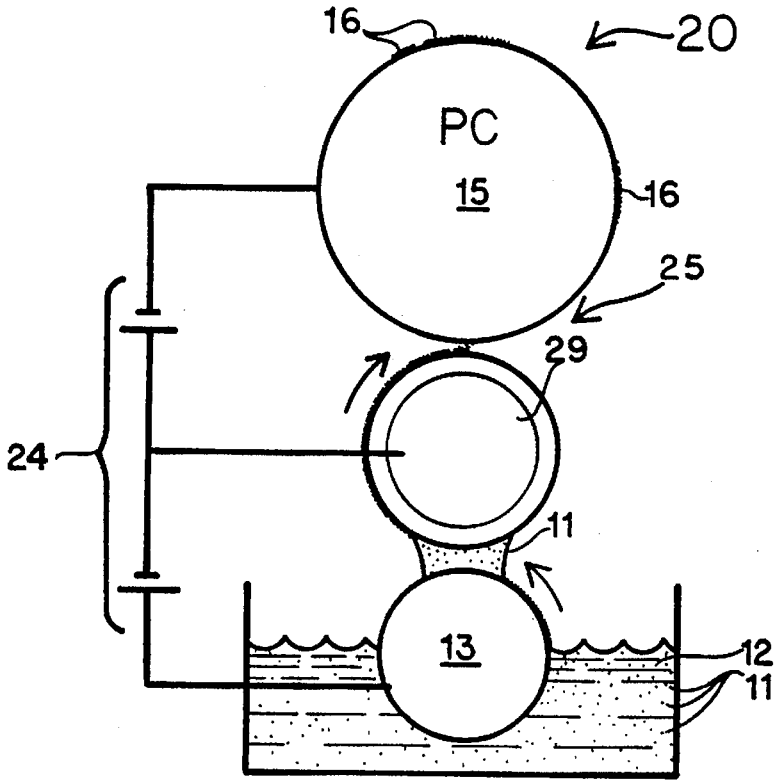
FIG. 2B is a schematic version of one embodiment of the invention with a minimal liquid meniscus formed between the conductive roller and the photoconductor, when the gap between the photoconductor and the conductive roller is zero.

In this present invention, a meniscus-free or minimal meniscus development process is accomplished by incorporating an intermediate conductive substrate, here roller 25, between roller 13 and charged photoconductor 15, as shown in FIG. 2A and FIG. 2B.

Figure 6:
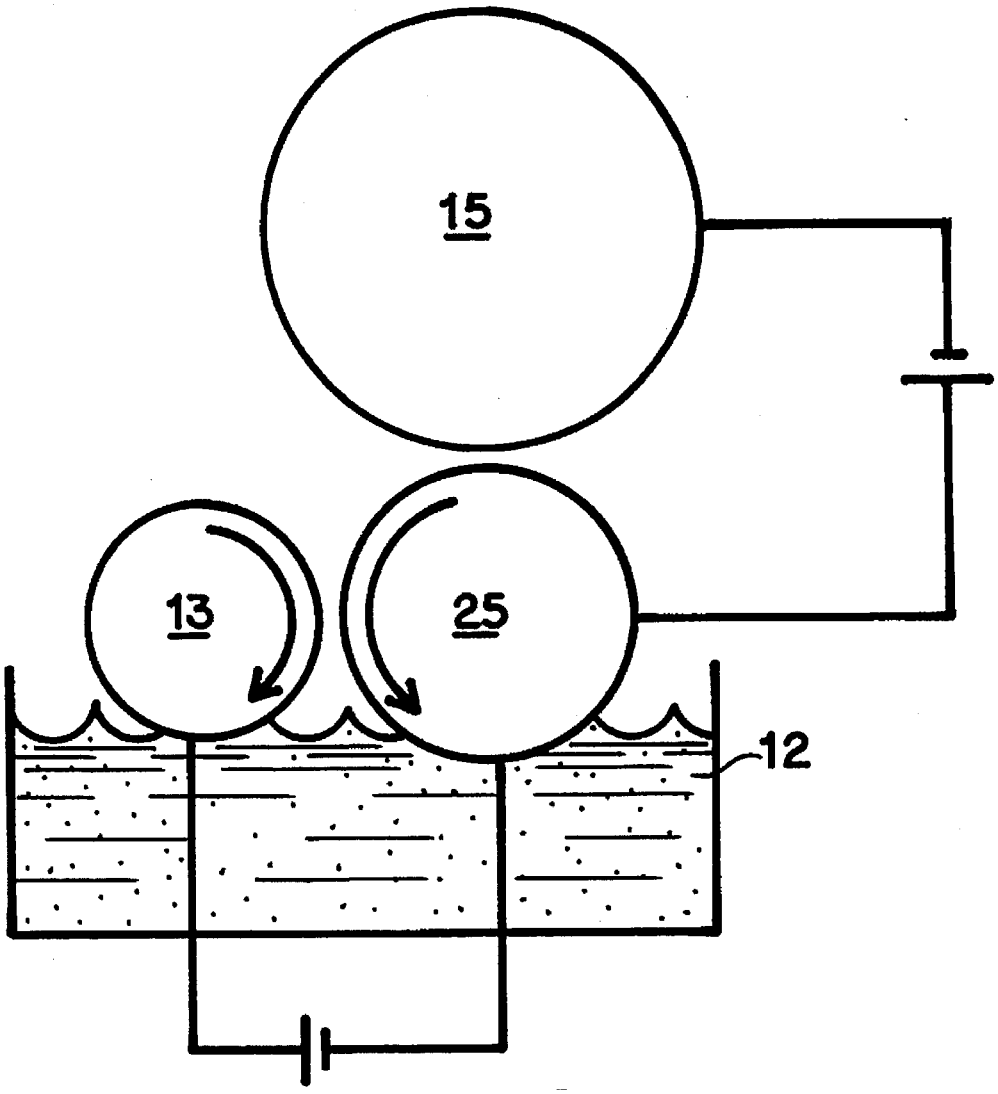
FIG. 6 is a schematic view of one embodiment of the invention, showing the components set in horizontal arrangement to reduce the amount of excess liquid carrier applied to the image bearing substrate.

In FIG. 2A, charged colorant particles 11 are electrically deposited uniformly on the surface of intermediate roller 25 as a result of electrophoresis via a normal, or large meniscus. In the present invention, the excess liquid carrier 12 on the surface of intermediate conductive roller 25 can be minimized by either a reverse rotation between intermediate roller 25 and roller 13 after they are set in a horizontal arrangement, as shown in FIG. 6; or by using a first squeeze mechanism, here squeeze roller 26, with or without a second squeeze mechanism, here second squeeze roller 32. The first squeeze mechanism 26 reduces the amount of liquid carrier 12 on conductive roller 25 by an appropriate contact along with an electrical bias with the same polarity as the toner particle between conductive roller 25 and squeeze roller 26 supplied by voltage source 23. The second squeeze mechanism 32 has a porous surface and accomplishes the removal of a microvolume of liquid carrier 22 by physically adsorbing liquid carrier 12 onto the porous surface of roller 32. In the embodiment of this process shown in FIG. 6, the reverse rotation between intermediate roller 25 and horizontally arranged roller 13 removes about 95% of liquid carrier 12 on conductive roller 25.

Referring to FIG. 2A, first squeeze roller 26 removes about 85% of liquid carrier 12 deposited on conductive roller 25, and the second squeeze mechanism removes approximately another 10% of liquid carrier 12 from conductive roller 25. This resulting remainder of liquid absolutely prevents formation of a meniscus between photoconductor 15 and conductive roller 25, as shown in FIG. 5A, when there is a gap between photoconductor 15 and conductive roller 25 larger than 0.5 mil. However, when the gap between conductive roller 25 and photoconductor 15 is smaller than 0.5 mil, there is a chance of the formation of a small or minimal meniscus, as shown in FIG. 5B, using the process shown schematically in FIG. 2B.

The electrically assisted migration of charged colorant particles 11 from conductive roller 25 toward photoconductor 15 in FIG. 2A is most likely due to the electrical breakdown of the air in the gap created by the electric field between the conductive substrate of the photoconductor 15 and the grounding plane 29 of conductive roller 25, when there is no contact between the outer surfaces of conductive roller 25 and photoconductor 15, that is when the gap between the two surfaces is greater than 0 and when no meniscus is formed. However, if there is a contact, that is, when the gap equals 0, the electrically assisted migration is the result of electrophoresis with a minimal meniscus.

In order to assist the electro-deposit of charged colorant particles 11 from liquid carrier 12 onto the surface of conductive roller 25, roller 25 must be adequately electrically conductive. The surface resistivity of conductive roller 25 must be smaller than $10^9$ Ωcm. The conductive materials of the intermediate conductive roller 25 can be selected from hard metals, such as aluminum, stainless steel, copper, nickel or the like; or it can be selected from softer materials including synthetic and natural rubber such as polyurethane, silicone rubber, polybutadiene rubber or the like. In this case, the rubber materials need to be doped with proper fillers to improve the electrical conductivity of the rolls, including metal oxide powders, such as $TiO_2$ and $Sn_2O_3$, or different kinds of carbon black, such as channel black, furnace black, lamp black, or the like.

The surface energy of the intermediate conductive roller 25 can also be adjusted by coating with low surface adhesion materials for example polydimethylsiloxane and fluorosilicone, teflon, other silicone resins, polycarbonates or the like. The purpose of a release coating on the intermediate conductive roller 25 is to facilitate the removal of charged colorant particles 11 from the surface of conductive roller 25 back to liquid carrier 12 after development. Particles 11 then can be redisbursed and reused again.

In other possible embodiments electrostatic latent image bearing substrate 15 can be a conductive roller or an insulator available for an ion depositing process. In the preferred embodiment, conductive roller 25 may be composed of a metal or other conductive material, preferably coated with a surface release material such as silicone, fluorocarbon, fluorosilicone, or the like. In the preferred embodiment, conductive roller 25 is made from silicone rubber, or any other material with appropriate properties of compliance and high conductivity, with an electric resistance in the range of $10^{+9}$ to $10^{+3}$ Ωcm. When conductive roller 25 is composed from a compliant material, this allows for a minimizing of the gap between conductive roller 25 and photoconductor 15. Pressure may be used as an option when conductive roller 25 is made from a compliant material, but the use of pressure is not necessary. The pressure in pounds per square inch (psi) that is used in the preferred embodiment is up to 20 psi, but this process can be accomplished in a range of 10 psi to 100 psi. The photoconductor 15 may be of the type described above, preferably coated with a surface release material, for example, silane coupling agents, silicone resins, including, for example, polydimethylsiloxane and polysiloxane, fluoroalkylethers, fluorinated polyesters, polycarbonates, or the like.

The charged colorant particles 11 represent the particulate component of liquid developer 12, and can be selected either from a film forming toner having a glass transition temperature ($T_g$) in the range between −10° C. and 40° C. or from a non-film forming toner component with $T_g$ of the binder higher than 40° C.

Figure 3:
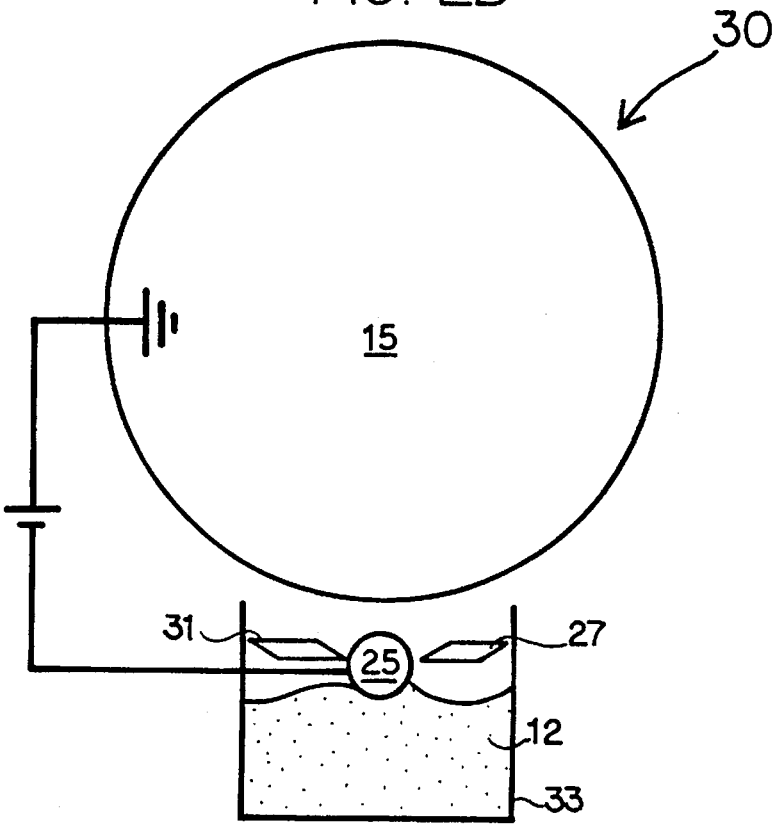
FIG. 3 is a schematic version of a second embodiment of the invention.

Another embodiment 30 of the invention is depicted in FIG. 3. There, charged colorant particles 11 are also dispersed in a bath of liquid carrier 12. In this embodiment, the concentration of particles 11 in liquid carrier 12 is very high, on the order of 25 wt. % or more, so that the viscosity of liquid carrier 12 is correspondingly very high and characteristically more like a paste than a free-flowing liquid. With the high viscosity liquid carrier 12, a metering blade 27 is used to control the application thickness of the slurry onto development electrode roller 13 before being deposited on to conductive roller 25. The metering blade 27 is optionally useful to replace squeeze roller 26 seen in FIG. 4.

The residual toner left on development roller 13 after the transfer of toner particles 11 to roller 25 may be recycled back to liquid carrier 12 by the application of scraper 31 to the surface of development roller 13 as seen in FIG. 3.

Figure 4:
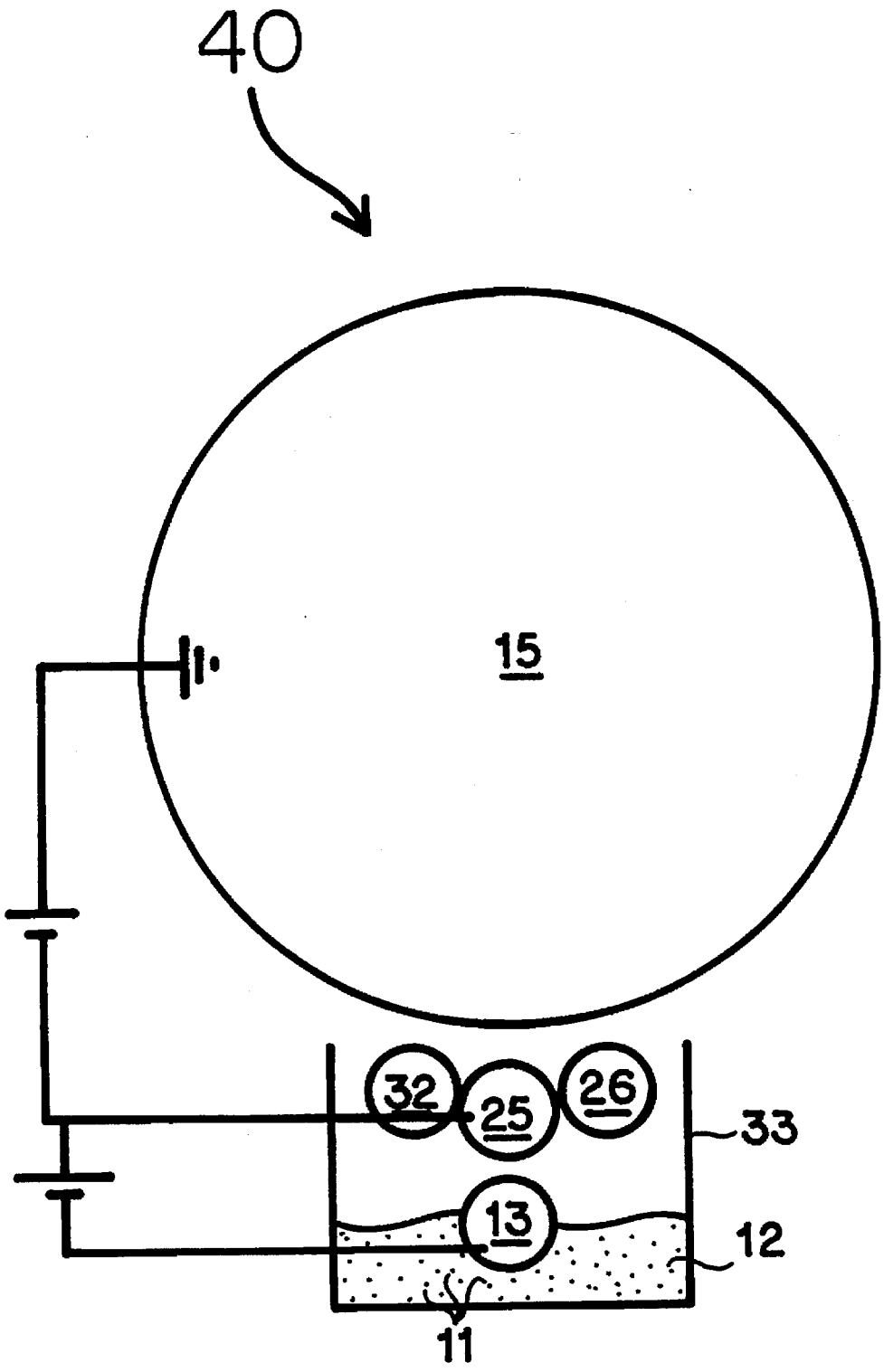
FIG. 4 is a schematic version of a third embodiment of the invention.

The dryness of toner particles 11 on conductive roller 25 can be controlled either electrostatically or non-electrostatically by a squeeze roller 26, as seen in FIGS. 2A and 4. The development efficiency at the gap between conductive roller 25 and photoconductor 15 is optimized by the dryness of toner particles 11 on conductive roller 25. A liquid content associated with toner particles 11 at the gap between conductive roller 25 and photoconductor 15 may be in the range of 90 weight % to 10 weight %. The desirable range of liquid content for toner particles 11 in this gap is between 75 weight % and 50 weight %. While it is necessary to the process of this invention to optimize the dryness of toner particles 11 on conductive roller 25, it is also necessary that some liquid from liquid carrier 12 be transferred with toner particles 11 to photoconductor 15. Without any liquid associated with toner particles 11, particles 11 cannot be transferred to photoconductor 15 because the adhesive forces between the toner particles 11 and conductive roller 25 will be greater than the electrostatic attraction forces of photoconductor 15.

In the preferred embodiment of this process the gap between conductive roller 25 and photoconductor 15 is zero. With a gap of zero, this dry development process will still work and this decreases the developmental bias and increases the dynamic range of toner on photoconductor 15. A small or no gap allows for a better and larger dynamic range for the toner. With a small gap or no gap, the transfer of particles 11 between conductive roller 25 and photoconductor 15 can be controlled by adjusting the bias current. A gap of zero is preferred, but this process can still be accomplished with a gap of up to five mils.

Toner particles 11 are attracted out of liquid carrier 12 and deposited on conductive roller 25 by electrophoresis. Toner particles 11 are then developed on to photoconductor 15 primarily electrostatically, by electrical charging of the air molecules and ion attraction, as seen in FIG. 5A. The remainder of toner particles 11 are developed onto photoconductor 15 through the attraction by electrophoresis and fluid surface tension properties of liquid carrier 12. The electrophoretic attraction causes the formation of an interface between liquid carrier 12 and solid surface of photoconductor 15 in the form of small or minimal meniscus as seen in FIG. 5B. This very minimal meniscus reduces the amount of liquid carrier 12 transferred. The normal amount of liquid carrier 12 transferred with other development processes is shown in FIG. 5C. The amount of liquid carrier 12 transferred to photoconductor 15 in the present invention is reduced to the extent that heating or air drying normally required with liquid toners is not required in the development process of this invention. Because the development process is carried out by electrical charging of the air molecules, the liquid carrier can be a dielectric liquid as described, or it can be a water based system. This development process can be accomplished with liquid toners that are film forming having a $T_g$ in the range between −10° C. and 40° C., as well as liquid toners that are non-film forming, with a $T_g$ greater than 40° C.

The utility of this novel development process includes improved environmental health and safety when using liquid toners. By being able to use less liquid toner, there is a decreased risk from the flammability associated with liquid toners which has a bearing on the storage and shipment of liquid toner waste. Decreasing the amount of liquid toner also decreases the human exposure through skin contact or inhalation of volatile components of the liquid toner. Another advantage of the process of this invention is that less liquid toner is employed that allows a simplification or decreased complexity in the imaging process.

In any of the embodiments of this invention, conductive roller 25 and development roller 13 may be sealed within a solvent box along with optional roller film-forming roller 32 and squeeze roller 26. By enclosing this portion of the process within a container, volatile emissions from liquid carrier 12 can be minimized to further improve the toxicological and environmental profile of this process.

Additionally, there is increasing concern about the indoor air quality of working areas where toners are used, both as to the comfort of the users and their health. With decreased use of liquid toner as a result of this novel dry development process, there can be increased indoor air quality. With this process, the dispersant can be recycled more easily for use in the toner after the electrophoretic separation and deposition of the toner particles.

As a carrier liquid for the liquid toner dispersions of this invention, those having an electric resistance of at least $10^{13}$ Ωcm and a dielectric constant of not more than 3.5 are preferred. Exemplary carrier liquids include straight-chain or branched-chain aliphatic hydrocarbons and the halogen substitution products thereof. Examples of these materials include octane, isoctane, decane, isodecane, decalin, nonane, dodecane, isododecane, etc. Such materials are sold commercially by Exxon Co. under the trademarks: Isopar®-G, Isopar®-H, Isopar®-K, Isopar®-L, Isopar®-V. These particular hydrocarbon liquids are narrow cuts of isoparaffinic hydrocarbon fractions with extremely high levels of purity. High purity paraffinic liquids such as the Norpar series of products sold by Exxon may also be used. These materials may be used singly or in combination. It is presently preferred to use Isopar®-H.

The pigments that are to be used are well known. For instance, carbon blacks such as channel black, furnace black or lamp black may be employed in the preparation of black developers. One particularly preferred carbon black is "Mogul L" from Cabot. Organic pigments, such as Phthalocyanine Blue (C.I.No. 74 160), Phthalocyanine Green (C.I.No. 74 260 or 42 040), Sky Blue (C.I.No. 42 780), Rhodamine (C.I.No. 45 170), Malachite Green (C.I.No. 42 000), Methyl Violet (C.I.No. 42 535), Peacock Blue (C.I.No. 42 090), Naphthol Green B (C.I.No. 10 020), Naphthol Green Y (C.I.No. 10 006), Naphthol Yellow S (C.I.No 10 316), Permanent Red 4R (C.I.No. 12 370), Brilliant Fast Pink (C.I.No. 15 865 or 16 105), Hansa Yellow (C.I.No. 11 725), Benzidine Yellow (C.I.No. 21 100), Lithol Red (C.I.No. 15 630), Lake Red D (C.I.No. 15 500), Brilliant Carmine 6B (C.I.No. 15 850), Permanent Red F5R (C.I.No. 12 335) and Pigment Pink 3B (C.I.No. 16 015), are also suitable. Inorganic pigments, for example Berlin Blue (C.I.No. Pigment Blue 27), are also useful. Additionally, magnetic metal oxides such as iron oxide and iron oxide/magnetites may be mentioned.

As is known in the art, binders are used in liquid toner dispersions to fix the pigment particles to the desired support medium such as paper, plastic film, etc., and to aid in the pigment charge. These binders may comprise thermoplastic resins or polymers such as ethylene vinyl acetate (EVA) copolymers (Elvax® resins, DuPont), varied copolymers of ethylene and an α,β-ethylenically unsaturated acid including (meth) acrylic acid and lower alkyl ($C_1$–$C_5$) esters thereof. Copolymers of ethylene and polystyrene, and isostatic polypropylene (crystalline) may also be mentioned. Both natural and synthetic wax materials may also be used. The binders are insoluble in the carrier liquid at room temperature.

While there is shown and described the present preferred embodiment of the invention, it is to be distinctly understood that this invention is not limited thereto but may be variously embodied to practice within the scope of the following claims.

I claim:

1. A method in an image formation process, for minimizing excess liquid carrier of a liquid developer transferred from a toner bath wherein the developer is composed of charged toner particles with a known electrical polarity and liquid carrier comprising:

a. applying an electrical bias with the same polarity as the toner particles between a conductive substrate and a squeeze mechanism;

b. electrically depositing the charged toner particles from the liquid developer onto the conductive substrate;

c. applying the squeeze mechanism to the conductive substrate to remove excess liquid carrier from the conductive substrate before transferring the charged toner particles from the conductive substrate to an electrostatic latent image bearing substrate;

d. transferring the charged toner particles from the conductive substrate to the electrostatic latent image bearing substrate wherein the electrostatic latent image bearing substrate is selected from the group consisting of a charged photoconductor and an insulator available for an ion depositing process; and e. returning the removed excess liquid carrier to the toner bath.

2. The method of claim 1 wherein no liquid meniscus is formed between the conductive substrate and the electrostatic latent image bearing substrate.

3. The method of claim 1 wherein a minimal liquid meniscus is formed between the conductive substrate and the electrostatic latent image bearing substrate.

4. The method of claim 1 wherein the liquid carrier is selected from the group consisting of dielectric hydrocarbons, purified, colorless oils, baby oils, mineral oil, vegetable oil.

5. The method of claim 1 wherein the toner particles are transferred from the conductive substrate to the electrostatic latent image bearing substrate across a gap up to 5 mils.

6. The method of claim 5 wherein the liquid carrier is water based when the gap between the conductive substrate and the electrostatic latent image bearing substrate is greater than zero.

7. The method of claim 1 wherein the conductive substrate exhibits surface energy greater than 16 dynes/cm.

8. The method of claim 1 wherein the electrostatic latent image bearing substrate exhibits surface energy greater than 16 dynes/cm.

9. The method of claim 1 wherein the liquid toner is selected from the group consisting of film forming liquid toners and non-film forming toners.

10. The method of claim 1 wherein the conductive substrate is composed of a material selected from the list consisting of metals, rigid conductive materials, silicone rubber, and compliant conductive materials.

11. A method in an image formation process, for minimizing excess liquid carrier of a liquid developer transferred from a toner bath wherein the developer is composed of charged toner particles with a known electrical polarity and liquid carrier comprising:

a. applying an electrical bias with the same polarity as the toner particles between a conductive substrate and a first squeeze mechanism;

b. electrically depositing the charged toner particles from the liquid developer onto the conductive substrate;

c. applying the first squeeze mechanism to the conductive substrate to remove excess liquid carrier from the conductive substrate before transferring the charged toner particles from the conductive substrate to an electrostatic latent image bearing substrate;

d. applying a second squeeze mechanism to the conductive substrate before transferring the charged toner particles from the conductive substrate to the electrostatic latent image bearing substrate; and e. transferring the charged toner particles from the conductive substrate to the electrostatic latent image bearing substrate wherein the electrostatic latent image bearing substrate is selected from the group consisting of a charged photoconductor and an insulator available for an ion depositing process: and f. returning the removed excess liquid carrier to the toner bath.

12. The method of claim 11 wherein no liquid meniscus is formed between the conductive substrate and the electrostatic latent image bearing substrate.

13. The method of claim 11 wherein a minimal liquid meniscus is formed between the conductive substrate and the electrostatic latent image bearing substrate.

14. The method of claim 11 wherein the liquid carrier is selected from the group consisting of dielectric hydrocarbons, purified, colorless oils, baby oils, mineral oil, vegetable oil.

15. The method of claim 11 wherein the toner particles are transferred from the conductive substrate to the electrostatic latent image bearing substrate across a gap up to 5 mils.

16. The method of claim 15 wherein the liquid carrier is water based when the development gap is greater than zero.

17. The method of claim 11 wherein the conductive substrate exhibits surface energy greater than 16 dynes/cm.

18. The method of claim 11 wherein the electrostatic latent image bearing substrate exhibits surface energy greater than 16 dynes/cm.

19. The method of claim 11 wherein the liquid toner is selected from the group consisting of film forming liquid toners and non-film forming toners.

* * * * *